United States Patent [19]

Shank

[11] Patent Number: 4,527,357

[45] Date of Patent: Jul. 9, 1985

[54] INTERNAL GRINDING MACHINE

[75] Inventor: William E. Shank, Waynesboro, Pa.

[73] Assignee: Litton Industrial Products, Inc., Waynesboro, Pa.

[21] Appl. No.: 588,815

[22] Filed: Mar. 12, 1984

[51] Int. Cl.[3] ..... B24B 19/11

[52] U.S. Cl. ..... 51/105 SP; 51/227 R; 51/290; 409/143

[58] Field of Search ..... 51/5 B, 5 C, 72 L, 73 R, 51/105 R, 105 SP, 105 HB, 90, 216 T, 217 T, 227 R, 237 R, 290; 409/143; 29/412, 415; 264/159

[56] References Cited

U.S. PATENT DOCUMENTS

| | | | |
|---|---|---|---|
| 1,227,304 | 5/1917 | Pedrick | 51/105 R |
| 1,353,558 | 9/1920 | Avillar | 409/143 X |
| 1,660,811 | 2/1928 | Perkins | 51/73 R |
| 2,238,785 | 4/1941 | Walton | 51/90 |
| 2,515,695 | 7/1950 | Caston | 51/105 R |
| 2,811,903 | 11/1957 | Harmes | 409/143 |
| 3,891,405 | 6/1975 | Huber | 51/105 R |

*Primary Examiner*—Robert P. Olszewski
*Attorney, Agent, or Firm*—Spencer T. Smith

[57] ABSTRACT

An internal grinding machine comprising a work head adapted to rotate about a selected axis and to be displaced in a direction perpendicular to that axis. The work head includes a workpiece holding fixture having a fixed lower jaw and an upper jaw displaceable from an open position to a closed position for clamping the outer periphery of a cylindrical workpiece having a longitudinally extending slot along the length thereof. The fixed jaw has a longitudinally extending key to be located within the keyway of the workpiece. A grinding spindle adapted to be rotated about and displaced along its axis includes a grinding wheel having a plurality of annular, outwardly projecting tapered grinding portions for effecting stock removal from a clamped workpiece and cutting the workpiece into a selected number of annular rings, as the workpiece holding fixture is advanced relative to the grinding wheel from a start position to a finish position. The longitudinally extending key has slots through which the grinding portions are fed as the workpiece holding fixture is displaced from the start position to the finish position. The fixed jaw and the movable jaw each have a clamping surface including a plurality of annular grooves for receiving the outwardly projecting grinding portions of the grinding wheel when the workpiece holding fixture has been advanced to the finish position.

1 Claim, 3 Drawing Figures

INTERNAL GRINDING MACHINE

SUMMARY OF THE INVENTION

The present invention relates to the manufacture of piston rings for internal combustion engines.

Traditionally, a piston ring is cut from a single piece of stock in a cutoff operation and the opposite parallel faces are subsequently ground to size by a grinding operation.

It is an object of the present invention to manufacture piston rings in a single machining operation.

Other objects and advantages of the present invention will become apparent from the following portion of the specification and from the accompanying drawings which illustrate, in accordance with the mandate of the patent statutes, a presently preferred embodiment incorporating the principles of the invention.

DESCRIPTION OF PREFERRED EMBODIMENT

In internal grinding, a workpiece W, here a tubular sleeve having a keyway 10 extending longitudinally along its entire length is mounted within the chuck or work holding fixture 12 of an internal grinding machine work head 14. The work head 14 is rotatably driven about the axis A of the cylindrical surface to be machined and the work head is supported by a cross-slide (not shown) which provides work head movement in a direction perpendicular to the axis of rotation (here lateral movement in a horizontal plane).

Figure 1:
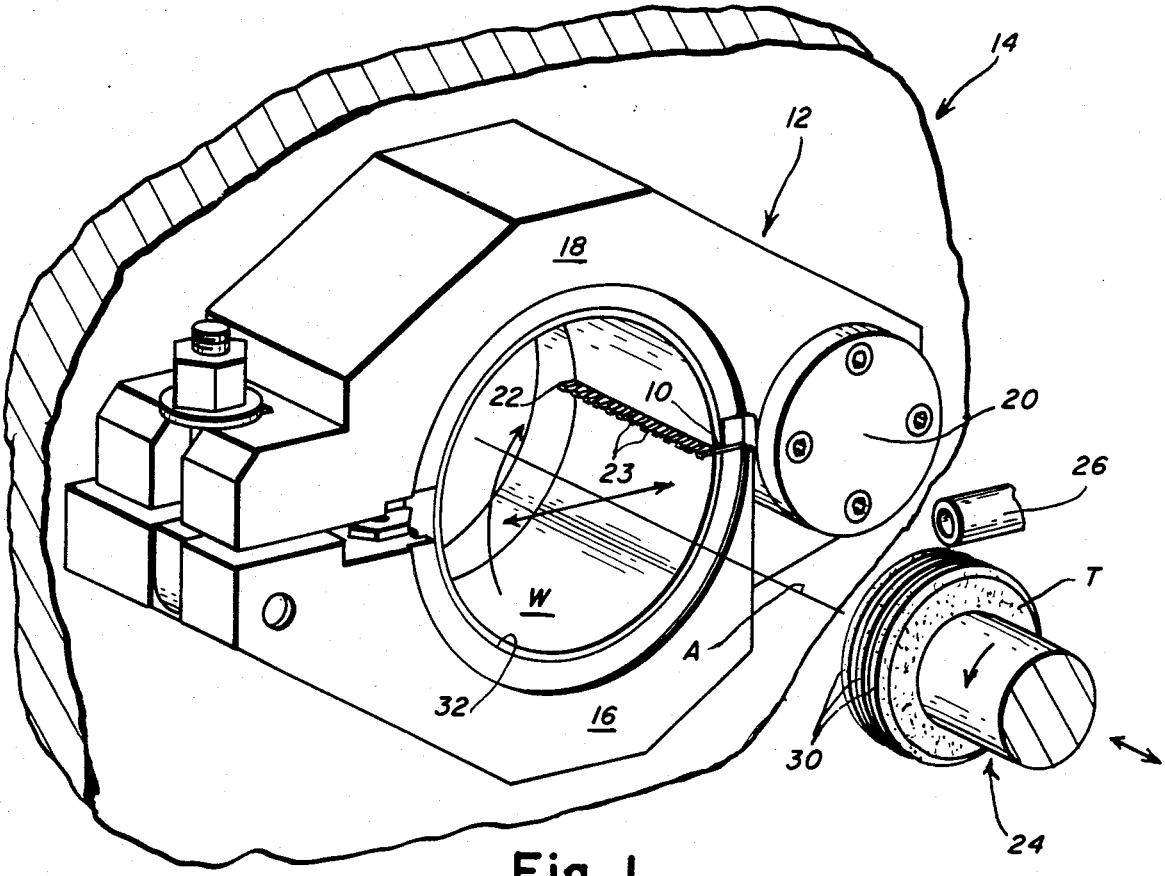
FIG. 1 is an oblique view of the work head and grinding spindle of an internal grinding machine made in accordance with the teachings of the present invention.
Figure 3:
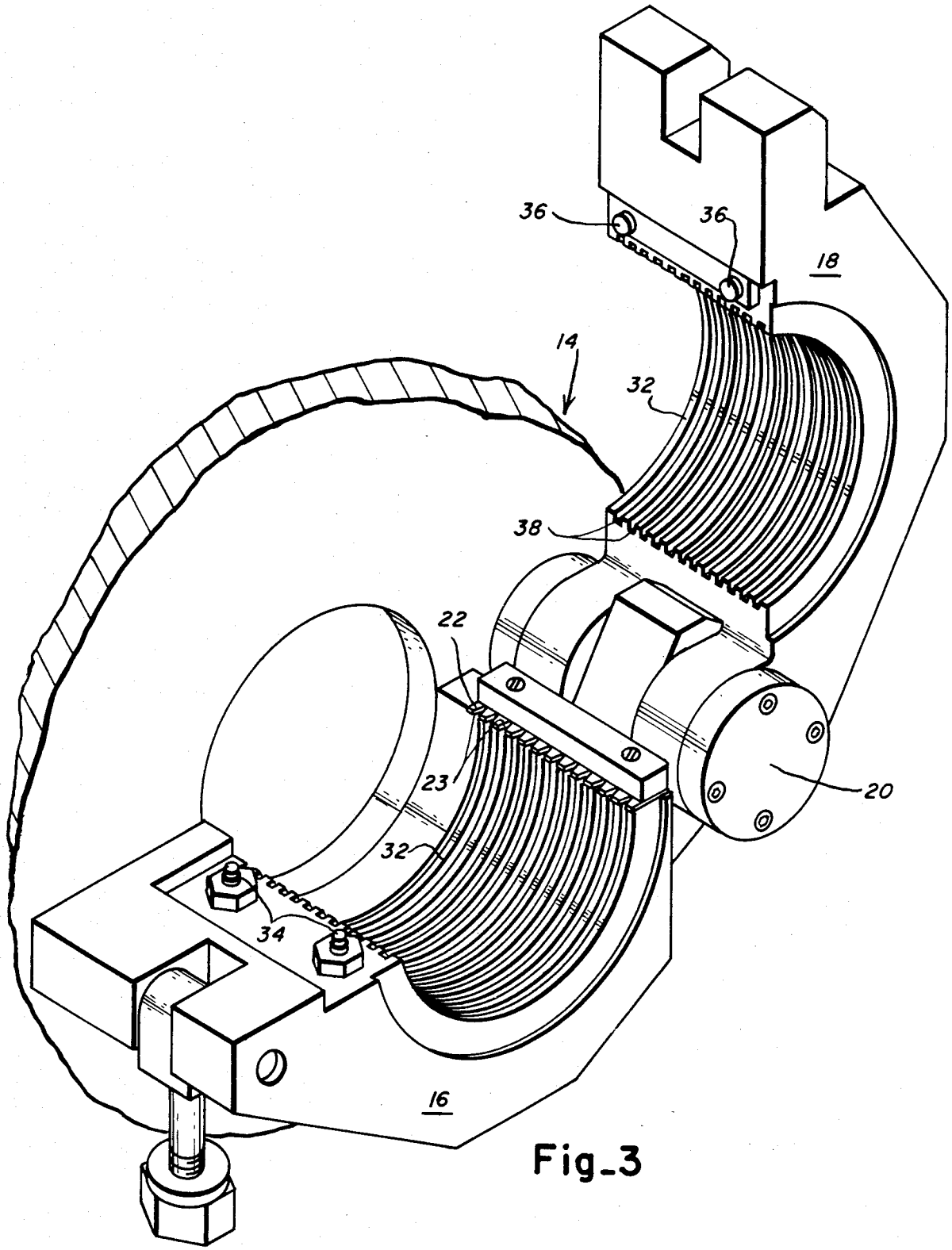
FIG. 3 is an enlarged oblique view of the work head illustrated in FIG. 1 with the work head chuck in the open position.

The chuck includes a lower fixed jaw 16 and an upper jaw 18 which is joined to the fixed jaw at a pivot 20 for pivotal movement from a closed position illustrated in FIG. 1 to an open position illustrated in FIG. 3.

The workpiece W is placed in the chuck or work holding fixture 12 so that a longitudinally extending key 22 which is secured to the lower fixed jaw 16 will be located within the workpiece keyway 10. The chuck will accordingly retain the workpiece in a set angular position and additionally retain the workpiece in a concentric manner.

The grinding spindle 24 which is rotatably driven about its axis is supported by a table slide (not shown) so that the grinding spindle can be displaced in the axial direction. The grinding spindle 24 includes a tool T in the form of a plated diamond or CBN wheel and a source of coolant 26.

Figure 2:
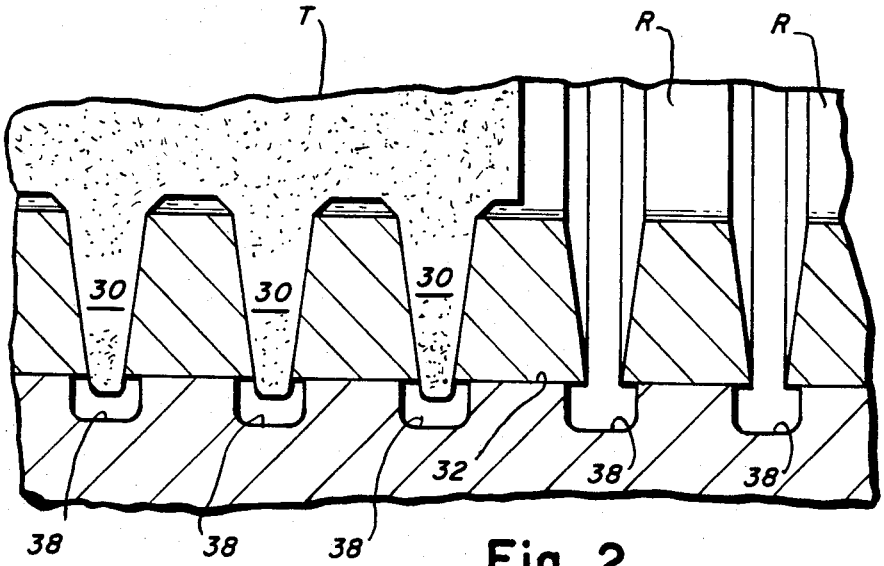
FIG. 2 is a cross-sectional view along the axis of the grinding spindle at the end of its machining operation.

As can be seen from FIGS. 1 and 2, the tool T is cylindrical in shape having a plurality of annular tapered ribs 30 which project radially outwardly from the center of the tool.

The chuck jaws each have a cylindrical work engaging surface 32 for effectively clamping the cylindrical workpiece W therebetween. The fixed jaw 16 has a pair of adjustable stops 34 which cooperate with a pair of stops 36 on the movable jaw 18 to define the precise contour of the clamping surface so that the workpiece can be clamped as desired. Each clamping surface 32 has defined therein a number of annular slots or channels 38.

In operation, the grinding spindle 24, which at the position shown in FIG. 1, is coaxial with the axis of the chuck 12, is axially advanced to a specific axial grind location. The work center is then rotatively driven and laterally displaced bringing the rotatively driven tool T into abrasive engagement with the workpiece W. The work center is further laterally displaced according to an infeed program until the grinding wheel or tool T has been advanced (relatively) to its finish position shown in FIG. 2. (In FIG. 2, the furthest piston rings to the right are the product of a previous infeed program.) The machining operation has resulted in the tool ribs entering the annular clamping surface channels or slots 38 thereby abrasively forming discrete piston rings R from the tubular workpiece. As can be seen in FIG. 1, the locating key 22 has channels 23 cut therein permitting unobstructed passage of the grinding wheel ribs to their finish location shown in FIG. 2.

Each piston ring R has tapered side surfaces which match the taper of the tool ribs 30 and cylindrical inner and outer diameters (in cross-section as shown in FIG. 2, the outer and inner surfaces are flat and parallel).

The work head 14 will be laterally retracted and the grinding wheel spindle will be axially advanced to the left to to the next grind location, and the procedure will be repeated until the workpiece W has been completely transformed into a plurality of identical piston rings. Alternately, a grinding wheel T having a number of ribs sufficient to complete all the piston rings in one operation could be used.

What is claimed is:

1. An internal grinding machine comprising:

a work head adapted to rotate about a selected axis and to be displaced in a direction perpendicular to said axis, said work head including a workpiece holding fixture having a lower fixed jaw, an upper jaw displaceable from an open position to a closed position for clamping the outer periphery of a cylindrical workpiece having a longitudinally extending slot along the length thereof, said fixed jaw having a longitudinally extending key to be located within the slot of the workpiece, a grinding spindle adapted to be rotated about and displaced along its axis including a grinding wheel having a plurality of annular, outwardly projecting tapered grinding portions for effecting stock removal from a clamped workpiece and cutting the workpiece into a selected number of annular rings, as said grinding wheel is advanced relative to said workpiece holding fixture from a start position to a finish position, said longitudinally extending key having slots defined therein through which said grinding portions are fed as said grinding wheel is displaced from said start position to said finish position, said fixed jaw and said movable jaw each having a clamping surface including a plurality of annular grooves for receiving said outwardly projecting grinding portions of said grinding wheel when said workpiece holding fixture has been advanced to said finish position.

* * * * *